US010669857B2

(12) United States Patent
Ahmad et al.

(10) Patent No.: US 10,669,857 B2
(45) Date of Patent: Jun. 2, 2020

(54) METHOD FOR PRODUCING A BASE BODY OF A TURBINE BLADE

(71) Applicant: Siemens Aktiengesellschaft, Munich (DE)

(72) Inventors: Fathi Ahmad, Kaarst (DE); Radan Radulovic, Bochum (DE)

(73) Assignee: Siemens Aktiengesellschaft, Munich (DE)

( * ) Notice: Subject to any disclaimer, the term of this patent is extended or adjusted under 35 U.S.C. 154(b) by 35 days.

(21) Appl. No.: 16/063,752

(22) PCT Filed: Dec. 8, 2016

(86) PCT No.: PCT/EP2016/080179
§ 371 (c)(1),
(2) Date: Jun. 19, 2018

(87) PCT Pub. No.: WO2017/114644
PCT Pub. Date: Jul. 6, 2017

(65) Prior Publication Data

US 2019/0338645 A1 Nov. 7, 2019

(30) Foreign Application Priority Data

Dec. 28, 2015 (EP) ..... 15202827

(51) Int. Cl.
*F01D 5/16* (2006.01)
*F01D 5/28* (2006.01)
*F01D 5/30* (2006.01)

(52) U.S. Cl.
CPC ..... *F01D 5/16* (2013.01); *F01D 5/288* (2013.01); *F01D 5/3007* (2013.01);
(Continued)

(58) Field of Classification Search
CPC ..... F01D 5/16; F01D 5/288; F01D 5/3007; F05D 2230/10; F05D 2230/90; F05D 2260/96
See application file for complete search history.

(56) References Cited

U.S. PATENT DOCUMENTS 5,215,442 A 6/1993 Steckle et al.
6,390,775 B1 5/2002 Paz
(Continued)

FOREIGN PATENT DOCUMENTS

EP 0537922 A1 4/1993
EP 1905950 A1 4/2008
(Continued)

OTHER PUBLICATIONS

EP search report dated Jun. 8, 2016, for EP patent application No. 15202827.0.
(Continued)

*Primary Examiner* — Dwayne J White
*Assistant Examiner* — Adam W Brown
(74) *Attorney, Agent, or Firm* — Beusse Wolter Sanks & Maire

(57) ABSTRACT

A method for producing turbine rotor blades or the base bodies thereof includes a) providing the base body, which has, following one another along a longitudinal axis, a blade root, a blade platform and a blade airfoil, b) sensing a value of at least one parameter of the base body, at least one of the parameters representing a vibrational property of the base body, c) comparing the sensed value with a predetermined target interval, d) if the sensed value lies outside the target interval, reducing the mass of the base body, wherein the reduction of the mass takes place at the blade root and/or on
(Continued)

the blade platform by introducing at least one recess and/or by reducing a dimension below the corresponding target value.

4 Claims, 2 Drawing Sheets

(52) U.S. Cl.
CPC ..... *F05D 2230/10* (2013.01); *F05D 2230/90* (2013.01); *F05D 2260/96* (2013.01)

(56) References Cited

U.S. PATENT DOCUMENTS

| | | | | |
|---|---|---|---|---|
| 6,814,543 | B2 * | 11/2004 | Barb | F01D 5/141 416/1 |
| 9,382,916 | B2 * | 7/2016 | Schoenenborn | F01D 5/005 |
| 9,410,436 | B2 * | 8/2016 | Kulathu | F01D 5/10 |
| 9,835,034 | B2 * | 12/2017 | Gronsfelder | F01D 5/16 |
| 2003/0206803 | A1 | 11/2003 | Herman et al. | |
| 2004/0219024 | A1 | 11/2004 | Soupizon et al. | |
| 2010/0129554 | A1 | 5/2010 | Ahmad | |
| 2012/0148401 | A1 * | 6/2012 | Kulathu | F01D 5/10 416/1 |

FOREIGN PATENT DOCUMENTS

| | | | | |
|---|---|---|---|---|
| EP | 1985803 | A1 | 10/2008 | |
| EP | 2957792 | A1 | 12/2015 | |
| JP | H05195703 | A | 8/1993 | |
| JP | 2002213205 | A | 7/2002 | |
| JP | 2004003471 | A | 1/2004 | |
| JP | 2004245222 | A | 9/2004 | |
| JP | 2010525229 | A | 7/2010 | |
| WO | WO-2014122028 | A1 * | 8/2014 | F01D 5/16 |
| WO | 2015157381 | A1 | 10/2015 | |

OTHER PUBLICATIONS

International Search Report dated Feb. 22, 2017, for PCT/EP2016/080179.

* cited by examiner

METHOD FOR PRODUCING A BASE BODY OF A TURBINE BLADE

CROSS REFERENCE TO RELATED APPLICATIONS

This application is the US National Stage of International Application No. PCT/EP2016/080179 filed Dec. 8, 2016, and claims the benefit thereof. The International Application claims the benefit of European Application No. EP15202827 filed Dec. 28, 2015. All of the applications are incorporated by reference herein in their entirety.

FIELD OF INVENTION

The invention relates to a method for producing a base body of a turbine rotor blade, comprising at least the successive steps of providing the base body, which comprises, following one another along a virtual longitudinal axis, a blade root, a blade platform and a blade airfoil, sensing a value of a parameter of the base body representing a vibrational property, comparing the sensed value with a predetermined target interval and, if the sensed value lies outside the target interval, reducing the mass of the base body. The invention also relates to a rotor blade ring for a rotor of an axially flowed-through turbine.

BACKGROUND OF INVENTION

It is known to provide turbine rotor blades with a protective layer, in order for them to have an increased lifetime during operation in a gas turbine. Often applied as a protective layer to the turbine rotor blade produced in a casting process is a corrosion protection layer of the type MCrAlY. The application of the protective layer takes place in the region of the surface that is exposed to the hot gas of the gas turbine during operation. This region comprises both the blade airfoil and the platform of the turbine rotor blade, on which the blade airfoil is integrally formed. Apart from the corrosion protection layer, a thermal barrier coating may be applied in the aforementioned region, in order to minimize as much as possible the amount of heat introduced into the base material of the turbine rotor blade from the hot gas. The application of the layers thereby changes the vibrational behavior of the turbine rotor blade.

It is also known that turbine rotor blades are excited to vibrate during the operation of the gas turbine. The vibrational excitation is caused by the rotation of the rotor on which the turbine rotor blades are secured. Also contributing to the vibrational excitation of the blade airfoils of the turbine rotor blades is the hot gas impinging on them. Since the blade airfoils of the turbine rotor blades rotate downstream of a ring of turbine guide vanes—seen in the direction of flow of the hot gas—they are excited to vibrate by hot gas pulsating on them. It is therefore required that each turbine rotor blade has a sufficiently high resonant frequency, so that the respective excitation frequencies of both the vibrational excitation originating from the rotational speed of the rotor and the vibrational excitation originating from the hot gas do not lead to an unacceptably great vibration of the blade airfoil. Accordingly, in the prior art the turbine rotor blades are designed in such a way that their resonant frequency deviates from the excitation frequencies of the stationary gas turbine. In the development of the turbine rotor blade, it is also ensured that, overall, the finished turbine rotor blade satisfies the requirements with respect to natural resonance, including with regard to the rotor speeds to be expected.

It is therefore envisaged in the production process of the turbine rotor blade to test each individual turbine rotor blade for its vibrational properties. In this test, the turbine blade is clamped at the root and made to vibrate by a mechanical impulse. Then the vibrational response of the turbine blade, and in particular its blade airfoil, is sensed. If the vibrational response of the turbine rotor blade does not comply with the predetermined frequency values for the resonant frequency, it must be discarded or manipulated by means of suitable measures in such a way that it meets the requirements for the resonant frequency, and is consequently suitable for operation. In order that turbine rotor blades that are not intended to be used in the gas turbine just because of their vibrational property are nevertheless passed on for use, it is known for example from EP 1 985 803 A1 to introduce a recess in the tip of the blade airfoil, whereby the mass of the turbine rotor blade can be reduced at its free, vibratory end. By reducing the mass of the turbine rotor blade, the vibrational property is positively influenced. Its resonant frequency can be shifted to higher values by removing the mass.

In addition, it is known from EP 0 537 922 A1 to insert a tubular damper in the blade platform of a turbine rotor blade. This damper can be pushed out slightly under centrifugal force, and thus come into contact with a platform of a neighboring blade to dampen blade-to-blade vibrations during operation.

SUMMARY OF INVENTION

The object of the invention is to provide a method for producing base bodies of turbine rotor blades that have resonant frequencies which meet the requirements for use within a stationary gas turbine. Another object is to provide a rotor blade ring of which the blade airfoils are particularly robust with respect to vibration excitement brought about by the hot gas.

The object relating to the method is achieved by the method according to the features of the independent claim, advantageous refinements being reflected in the subclaims. The object relating to the rotor blade ring is achieved by the features of the claims.

The invention is based on the realization that the introduction of the recesses for setting the resonant frequency does not have to be performed just on the blade airfoil. In particular, the measure for influencing the vibrational properties of the turbine blades or their cast base body may also be performed at the blade root or on the so-called platform underside. The platform underside is in this case the side of the platform of a turbine rotor blade or the base body that is opposite from the hot gas side of the platform, and is consequently facing the blade root. The introduction of recesses or the reduction of a dimension below the target value may be provided as measures. It goes without saying that the two measures can also be combined with one another.

The advantages of the two measures are that they neither change the structural-mechanical integrity of the blade airfoil nor impair its aerodynamics. This makes it possible to achieve the predetermined lifetime and performance values of the blade base body and of the turbine rotor blade ultimately produced from it.

Consequently, the invention proposes that the blade base body has at the blade root and/or on the underside of the platform a region of which the shape and/or dimensions are chosen so as to have no structural-mechanical functions. On the basis of this property and the dimensions originally provided, the base body comprises at least one region that is regarded as a sacrificial region, in order by reducing the mass there to change the vibrational properties of the base body without the functional properties changing at the same time. For reducing the mass, a recess may for example be introduced into a planar side of the blade root. Another example is reducing the width of a web that is provided on the platform underside of the turbine blade.

The regions in which the measures described above can be carried out are advantageously situated there without the structural-mechanical integrity of the base body required for the relevant mechanical loading that occurs during operation being significantly impaired. Consequently, those geometrical moments of inertia and that stiffness of the turbine rotor blades that do not in any case limit the lifetime of the turbine blade are changed. Consequently, the predetermined lifetime of the turbine rotor blade remains uninfluenced.

Advantageously, the region concerned or the regions concerned lies or lie outside those areas of the base body that can be flowed over by a hot gas. Consequently, the method can also be applied after coating turbine rotor blades with an erosion and/or thermal barrier coating.

Advantageously, the method according to the invention is applied in quite a late phase of the production process of the turbine blades. This means that the base body usually produced by the casting process has already been brought to the target size before sensing the value of the parameter representing a vibrational property. It is thereby ensured that the vibration measurement is performed on the almost finished turbine rotor blade, and consequently further production steps, which may similarly change the vibrational properties of the base body or the turbine rotor blade, are at least largely avoided.

More advantageously, the method may also be carried out before the coating of the main body, if it can be determined in advance by which (average) value the sensed value of the parameter changes as a result of the subsequently applied coating. Then, the aforementioned measures can already be carried out in an early phase of the production process, in order to select those base bodies of which the vibrational properties and values could not be brought into the associated target intervals in spite of carrying out the measures according to the invention. In this way, expenditure for rejects can be avoided at an early time.

Expediently, only some of the turbine rotor blades of a blade ring, or even all of them, are produced according to the aforementioned method.

In this application, a terminological distinction is made between a turbine rotor blade and a base body of a turbine rotor blade. In this case, a turbine rotor blade is understood as meaning the finished blade, intended for being secured to a rotor of a turbine without further working. As a difference from this, the base body of a turbine rotor blade is understood as meaning a turbine rotor blade blank that is still in the midst of the production process that ends with the finished turbine rotor blade. Consequently, the invention only relates to some of the production steps that are required altogether for producing a ready-to-use turbine rotor blade, it also being possible for the method steps mentioned here to be the very last production steps for producing the ready-to-use turbine blade.

The invention is explained on the basis of a drawing, identical designations describing components that act the same.

DETAILED DESCRIPTION OF INVENTION

Figure 1:
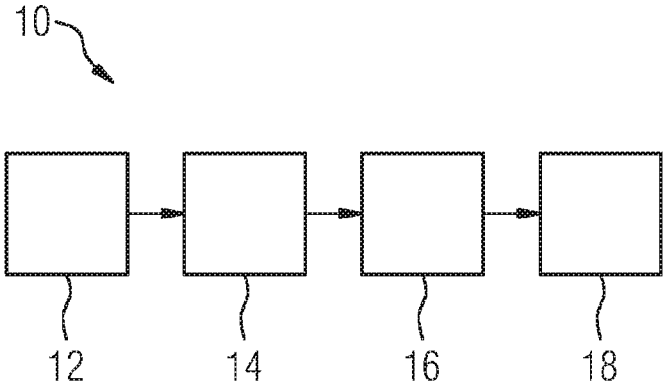
FIG. 1 shows a flow diagram with the various production steps of a method according to the invention for producing a base body of a turbine rotor blade.
Figure 3:
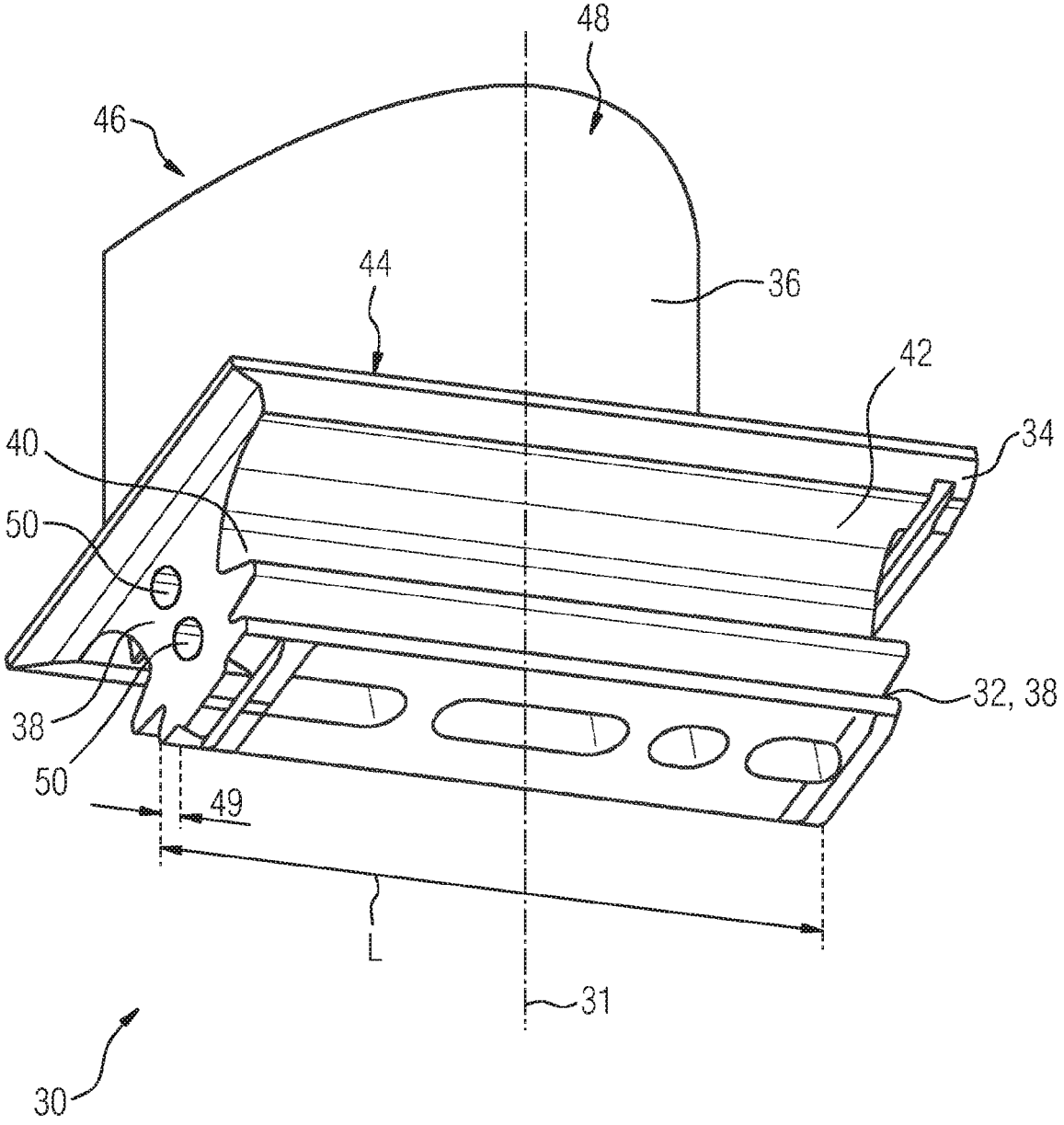

The method 10 according to the invention is represented in FIG. 1. The method 10 for producing a base body 30 (FIG. 3) of a turbine rotor blade comprises in a first step 12 the provision of the base body 30 of the turbine rotor blade. The base body 30 comprises, following one another along a virtual longitudinal axis 31, a blade root 32, a platform 34 and a blade airfoil 36.

When its planar end face 38 is viewed perpendicularly, the contour of the blade root 32 is firtree-shaped and goes over via a so-called blade neck 40 into an underside 42 of the platform 34. Opposite from the underside 42, the platform has a hot gas side 44, which is monolithically adjoined by the blade airfoil 36. The latter is formed in the shape of a droplet and is aerodynamically curved to form a pressure side 46 and a suction side 48.

The blade root 32 extends over a length L between the two planar end faces 38 lying axially opposite one another.

In a second production step 14, a variable of at least one parameter of the base body 30 is sensed, at least one of the parameters representing a vibrational property of the base body. Usually, the resonant frequencies and the vibration modes are sensed by the usual methods.

In a third production step 16, the sensed value or the sensed values is or are compared with a target interval (associated target interval). If the sensed values lie outside the associated target interval, according to the invention vibration-changing measures are carried out at the blade root 32 and/or on the underside 42 of the platform 36 as a fourth production step. These measures may be the introduction of one or more recesses 50 and/or the reduction of the previous dimensions, such as length, width or height, of certain features arranged there. For example, the length L of the blade root 32 may be shortened by several hundredths of a millimeter to a size that lies below the otherwise intended target value for the length L. The reduction of the mass of the base body 30 takes place in the region 49 that has been provided in particular for this. Consequently, the weight, and possibly the pressure-exerting surface, of the turbine rotor blade changes under centrifugal force, which has favorable effects on the vibrational property of the turbine rotor blade.

In case of doubt, the second, third and fourth steps 14, 16, 18 are performed repeatedly as a series, to test the suitability of the base body 30. Only when the turbine rotor blades investigated satisfy the requirements with regard to the vibrational property are they passed on to the further production process.

The base body 30 or the turbine rotor blade may also be a body or blade that is or is to be provided with a protective layer. The protective layer is in this case advantageously a corrosion protection layer of the type MCrAlY. Alternatively, a two-layer or multi-layer protective coating may also be provided, comprising a layer of the MCrAlY type as a bonding coat, on the outside of which a ceramic thermal barrier coat (TBC) has also been applied. By applying the protective layer, in particular a corrosion protection layer, the mass of the base body is further increased. The changing of the resonant frequency accompanying the increase in mass can be compensated by introducing recesses 50 at the blade root 32 or on the underside of the platform 34. It is in this case intended that recesses are introduced in sufficient numbers and with sufficient depths to make the turbine rotor blade satisfy the requirements for the resonant frequency. It may in this case be that the resonant frequency cannot be influenced strongly enough to satisfy the requirements in spite of applying the method according to the invention. In this case, the base body is not suitable for commercial use.

The coating of the base body 30 may be performed before the second production step 14 is carried out for the first time or after the fourth production step 18 is carried out for the last time.

By means of the recess 50 arranged on the end face in the blade root 32, a frequency shift of the resonant frequency takes place. The recesses 50 may be of any desired shape.

Figure 2:
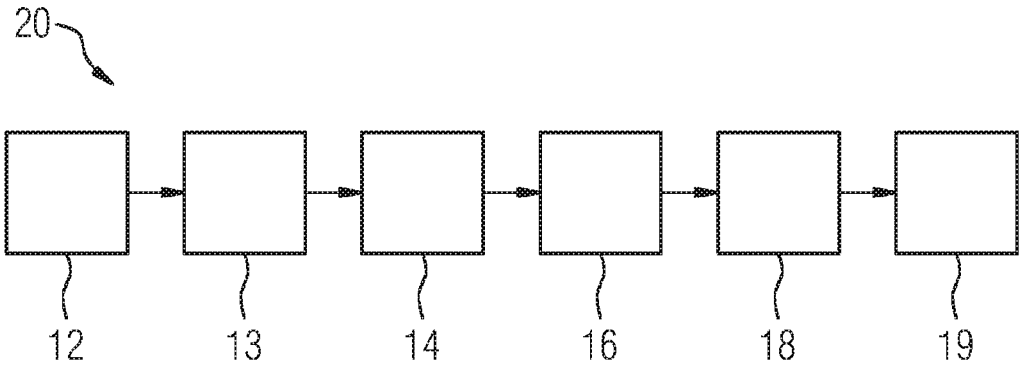
FIG. 2 shows a flow diagram with further production steps and FIG. 3 shows a perspective view of an underside of a base body of a turbine rotor blade.

FIG. 2 shows a second flow diagram for a further exemplary embodiment of a production method. According to the further exemplary embodiment, the production process comprises the previously mentioned steps 12, 14, 16, 18, supplemented by production steps 13 and 19 to be carried out in some cases in between. This has the effect on the one hand of supplementing the production step 13, in which the base body 30 is at least to the greatest extent produced to size. In other words: in this production step, the dimensions of the base body 30 that are affected by casting tolerances are brought to the planned target values, which for their part may similarly be affected by tolerances.

In the production step 19, an until then uncoated base body 30 can be provided with an erosion and/or thermal barrier coating.

Altogether, the invention consequently proposes a method for producing turbine rotor blades, or their base bodies 30, of which the frequency property can be adapted particularly easily to the required boundary conditions. For this purpose, it is provided that recesses 50 are introduced into the blade root 32 and/or a dimension is reduced below the corresponding target value if the base body 30 has insufficient vibrational properties. This provides a method by which the vibrational property of the turbine rotor blade can be set in a particularly easy and variable manner. As a result, the reject rate in the production of turbine rotor blades can be reduced.

The invention claimed is:

1. A method for producing a base body or a turbine rotor blade, comprising at least the successive steps of a) providing the base body, which comprises, following one another along a longitudinal axis, a blade root, a blade platform and a blade airfoil, b) sensing a value of at least one parameter of the base body, at least one of the parameters representing a vibrational property of the base body, c) comparing the sensed value with a predetermined target interval, d) if the sensed value lies outside the target interval, reducing the mass of the base body, wherein the reduction of the mass takes place at the blade root by introducing at least one recess and/or by reducing a dimension below the corresponding target value.

2. The method as claimed in claim 1, in which the reduction of the mass takes place at a region or regions of the blade root, and wherein the region concerned or the regions concerned lies or lie outside those regions of the base body that can be flowed over by a hot gas.

3. The method as claimed in claim 1, in which, before carrying out step b), at least most of the dimensions of the base body are brought to their target size.

4. A rotor turbine ring for a rotor of an axially flowed-through turbine, comprising:

a number of turbine rotor blades, wherein the base bodies of which are produced by a method as claimed in claim 1.

* * * * *